US008393134B2

(12) United States Patent
Morgante

(10) Patent No.: US 8,393,134 B2
(45) Date of Patent: Mar. 12, 2013

(54) BIT

(75) Inventor: Adrian Morgante, Surfers Paradise (AU)

(73) Assignee: Intelligent Inventions Limited, Queensland (AU)

( * ) Notice: Subject to any disclaimer, the term of this patent is extended or adjusted under 35 U.S.C. 154(b) by 111 days.

(21) Appl. No.: 12/721,029

(22) Filed: Mar. 10, 2010

(65) Prior Publication Data

US 2010/0170207 A1 Jul. 8, 2010

Related U.S. Application Data

(63) Continuation-in-part of application No. PCT/AU2008/001785, filed on Dec. 3, 2008.

(51) Int. Cl.
*B68B 1/06* (2006.01)

(52) U.S. Cl. ..... 54/8

(58) Field of Classification Search ..... 54/7–9
See application file for complete search history.

(56) References Cited

U.S. PATENT DOCUMENTS

| | | | | |
|---|---|---|---|---|
| 31,557 | A | 2/1861 | Roberds | |
| 169,403 | A * | 11/1875 | Bellinger, et al. | 54/8 |
| 367,416 | A | 8/1887 | Lilly | |
| 557,862 | A * | 4/1896 | McCulloch et al. | 54/8 |
| 709,700 | A * | 9/1902 | Drown | 54/7 |
| 823,565 | A * | 6/1906 | Turton | 54/8 |
| 908,824 | A * | 1/1909 | Williamson | 54/9 |
| 1,806,483 | A * | 5/1931 | Meyer | 54/8 |
| 3,750,368 | A | 8/1973 | Hyland | |
| 4,380,888 | A | 4/1983 | Lanham | |
| 4,965,987 | A | 10/1990 | Bork | |
| 6,834,482 | B2 * | 12/2004 | Collins, III | 54/8 |
| 2004/0200196 | A1 * | 10/2004 | Hsi-Chang et al. | 54/9 |

FOREIGN PATENT DOCUMENTS

| | | |
|---|---|---|
| AU | 26757/88 | 7/1991 |
| DE | 202005018135 U | 3/2006 |

* cited by examiner

*Primary Examiner* — Rob Swiatek
*Assistant Examiner* — Kathleen Iwasaki
(74) *Attorney, Agent, or Firm* — DeLio & Peterson, LLC

(57) ABSTRACT

A bit includes a mouthpiece. A tongue member is arranged on the mouthpiece such that, when the mouthpiece is received in an oral cavity of an animal, the tongue member bears against a tongue of the animal, inhibiting movement of the tongue over the mouthpiece.

16 Claims, 9 Drawing Sheets

BIT

This application is a Continuation-In-Part of PCT Application No. PCT/AU2008/001785, filed Dec. 3, 2008, and claims priority from Australian Patent Application No. 2007906587, filed on Dec. 3, 2007 and from Australian Patent Application No. 2010200178, filed on Jan. 15, 2010.

FIELD OF THE INVENTION

This invention relates to a bit. More specifically, but not exclusively, this invention relates to a bit for use with animals such as horses.

BACKGROUND ART

This section of the specification is not an admission of prior art relevant to the invention as claimed. As such, it is not the Applicant's intention that the material of this section be taken into account in an assessment or interpretation of the invention as claimed.

In general, a bit used for riding an animal, such as a horse, typically consists of two basic components, namely a mouthpiece that goes inside the horse's mouth, and bit rings or the like allowing the mouthpiece to be attached to a bridle and reins.

A bit typically acts with some combination of pressure and leverage, often in conjunction with pressure applied by other parts of the bridle, in order to control an animal.

By its very nature, a bit obstructs free breathing in a horse. Usually, a bit is positioned over the tongue of the horse. However, bits can cause a horse severe discomfort. For example, in the case of jointed or snaffle bits, when reins are pulled, the bit collapses, forming a vertex at the joint of the bit. The acute side of the vertex can be driven into the horse's tongue. The tongue is then pinched and can even be cut as the snaffle bit exercises a nutcracker action on the tongue. The more mouth pain inflicted, the more fear is instilled in the horse and the more difficult and disobedient it becomes.

As a result of that discomfort and pain, the horse will usually attempt to shift its tongue. The tongue can then find itself positioned over the bit. FIG. 1 of the attached drawings indicates the problem associated with such a tongue position. As can be seen, the head 10 has a nasal cavity 12 and an oral cavity 14. A frontally positioned hard palate 16 and a rearward soft palate 18 separate the nasal and oral cavities 12, 14. The soft palate 18 is able to move depending on whether the horse is swallowing or breathing. The arrows 11 indicate the direction of inward breath in FIG. 1(*a*) and the direction of food intake in FIG. 1(*b*).

As can be seen in FIG. 1(*a*), the soft palate 18 is positioned against the tongue 20 and retained in that position by the larynx 22 while the horse is breathing. In that condition, the naso-pharynx 27 and the larynx 22 are open, allowing air to pass through the nasal cavity 12 and into the windpipe 24. Also in that condition, the larynx 22 keeps the gullet 26 closed.

On the other hand, as can be seen in FIG. 1(*b*), when the horse swallows, the soft palate 18 is moved against the roof 28 of the naso-pharynx 27, closing the naso-pharynx 27. In that position, the larynx 22 is closed and the oro-pharynx 29 is open, the soft palate 18 allowing the gullet 26 to open and food and liquid to pass through the gullet 26.

When the mouthpiece finds its way under the tongue 20, the soft palate 18 is pushed into the naso-pharynx 27. This causes the larynx 22 to obstruct or close the windpipe 24, resulting in the horse choking or having other breathing difficulties. As a result, the horse can become disobedient and difficult to handle.

SUMMARY OF THE INVENTION

According to a first aspect of the invention, there is provided a bit which comprises a mouthpiece; and a tongue member arranged on the mouthpiece such that, when the mouthpiece is received in an oral cavity of an animal, the tongue member bears against a tongue of the animal, inhibiting movement of the tongue over the mouthpiece.

It follows that the invention provides a means whereby a horse's tongue can be inhibited from being positioned over the mouthpiece. Such an invention therefore helps to address the problems set out above.

The position of the tongue member may be adjustable with respect to the mouthpiece.

The tongue member may be fastened to the mouthpiece with a fastening arrangement. The tongue member may be in the form of a plate with a number of perforations to accommodate the fastening arrangement, the perforations being configured so that selection of perforations can provide adjustability of the plate with respect to the mouthpiece.

The mouthpiece may have two pivotally interconnected joints. The joints may be interconnected with complementary eyelets defined at respective connected ends of the joints, the fastening arrangement including a fastening element that is received through at least one of the eyelets to maintain integrity of the mouthpiece in the event that one or both of the eyelets break. This fastening element may be configured to permit angular adjustment of the tongue-engaging member relative to the mouthpiece to suit the individual horse.

The tongue member may be pivotal with respect to the mouthpiece, which is arranged intermediate operatively front and rear edges of the tongue member such that, when a frontal portion of the tongue member is urged towards a roof of the oral cavity, a rearward portion presses onto the tongue to inhibit excessive pulling by the animal.

The mouthpiece may generally be in two parts, the tongue member having two portions arranged on respective parts of the mouthpiece. The mouthpiece may have pivotally interconnected joints, with a portion arranged on respective joints, such that, when the joints pivot operatively backwardly and towards each other, in use, the portions overlap to present a single structure that bears against the horse's tongue.

The mouthpiece may be a one-piece component that defines an opening, the tongue member defining at least one complementary opening, a suitable fastener being received through the openings to fasten the tongue member to the one-piece component.

The tongue member and the mouthpiece may have a unitary, one-piece structure. The tongue member may be capable of being fastened to a mouthpiece of the bit and may be configured so that, when the mouthpiece is received in an oral cavity of an animal, the tongue member bears against a tongue of the animal, inhibiting movement of the tongue over the mouthpiece.

In one embodiment, the mouthpiece includes a pair of elongate mouthpiece members complementarily engaged together and the tongue member defines apertures, the bit further comprising a fastener for extending through the mouthpiece members and apertures to fasten the mouthpiece members to the tongue member.

The apertures may be arranged in two rows, and the mouthpiece members define passages which can be aligned with respective rows to receive the fastener. The fastener may include a cover from which a pair of posts can extend through the passages. Rings may be provided at either end of the mouthpiece to which a bridle and reins can be attached.

Optionally, the tongue member includes a lower frontal portion and a higher rear portion, with each portion oppositely tapering to an apex. Preferably, the lower portion includes apertures arranged in pairs, the underside of the lower portion defining curved surfaces between respective aperture pairs. The lower portion may further include sockets in register with apertures for receiving fastener extremities. The tongue member may have a generally Z-shaped profile.

According to another aspect of the present invention, there is provided a tongue member for a bit, the tongue member capable of being fastened to a mouthpiece of the bit and being configured so that, when the mouthpiece is received in an oral cavity of an animal, the tongue member bears against a tongue of the animal, inhibiting movement of the tongue over the mouthpiece.

The invention is now described, by way of example, with reference to the accompanying drawings. The following description is intended for illustrative purposes only, such that a person of ordinary skill in the art can put an embodiment of the invention into effect. As such, the following description is not intended to limit the scope of the claims or of the preceding paragraphs.

DESCRIPTION OF EMBODIMENTS OF THE INVENTION

Figure 1A:
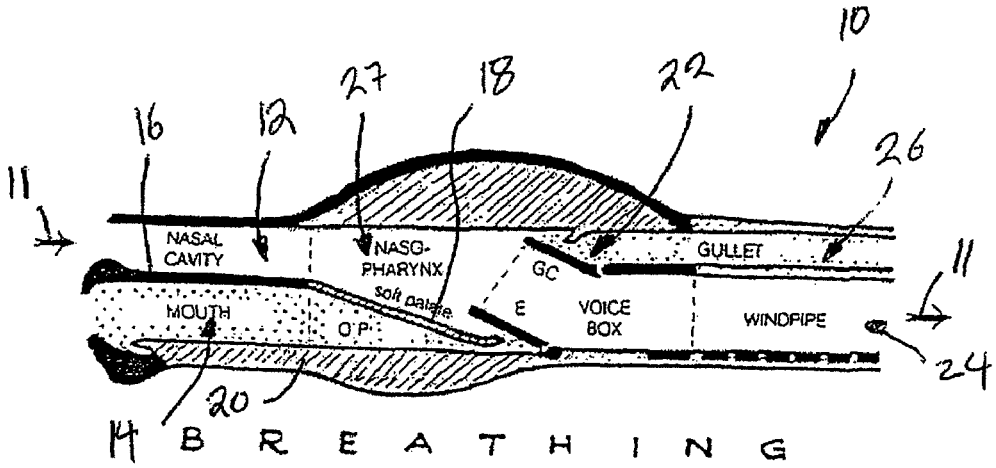
FIGS. 1(*a*) & (*b*) show a schematic, functional view of a horse's head in breathing and swallowing conditions, respectively.
Figure 1B:
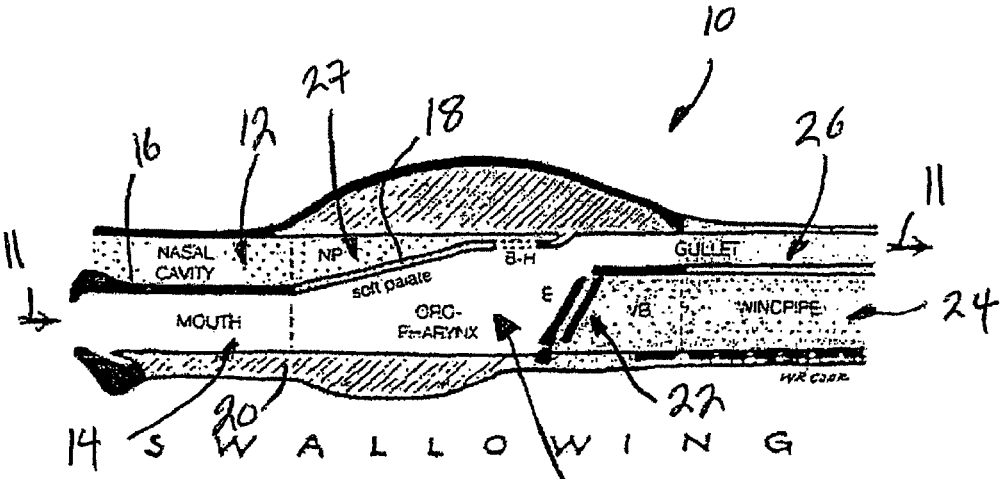
Figure 2:
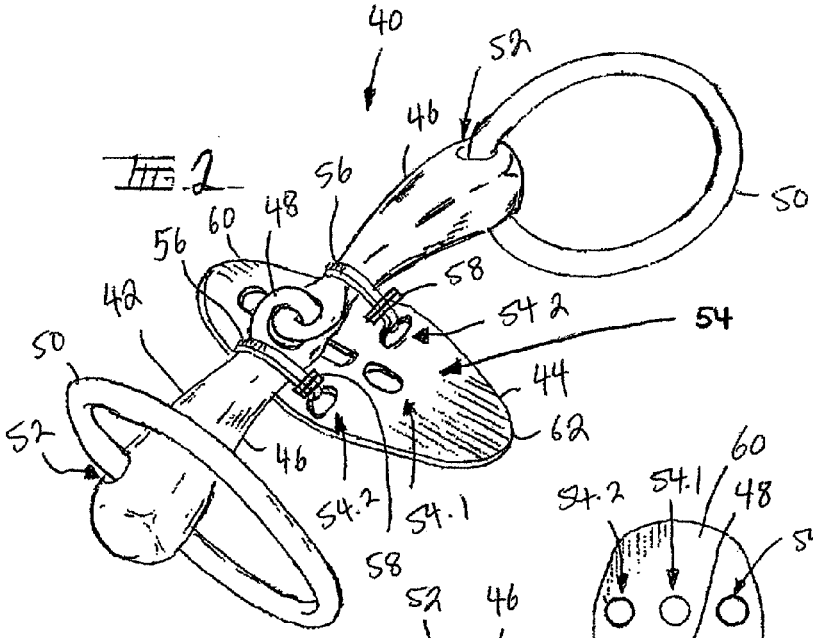
FIG. 2 shows one embodiment, in accordance with the invention, of a bit with a jointed mouthpiece.

In FIG. 2, reference numeral 40 generally indicates one embodiment, in accordance with the invention, of a bit.

The bit 40 includes a jointed mouthpiece 42, of the type found in snaffle bits. In this particular embodiment, the bit 40 is effectively a snaffle bit with a tongue-engaging member or plate 44 fastened to the mouthpiece 42.

The bit 40 includes a pair of joints 46 that interconnect with corresponding eyelets 48, in a complementary and conventional manner. A ring 50 is received through openings 52 in a free end of each joint 46.

The plate 44 defines a number of apertures 54. In this embodiment, there is a central row of four apertures 54.1 and a row of three apertures 54.2 on each side of the row 54.1.

A fastening arrangement in the form of a pair of cable ties 56 are used to fasten the plate 44 to the mouthpiece 42. A cable tie 56 passes over each joint 46 and through the openings 54.2. For the sake of comfort, connectors 58 of the cable ties 56 are positioned above the plate 44 and behind the joints 46.

It will be appreciated that the plate 44 can pivot somewhat with respect to the mouthpiece 42. Thus, when the horse pushes its tongue 20 upwardly against a frontal portion 60 of the plate 44, in a possible attempt to place the tongue 20 over the mouthpiece 42, a rearward portion 62 presses on the tongue gently to discourage the horse from this habit.

Figure 3:
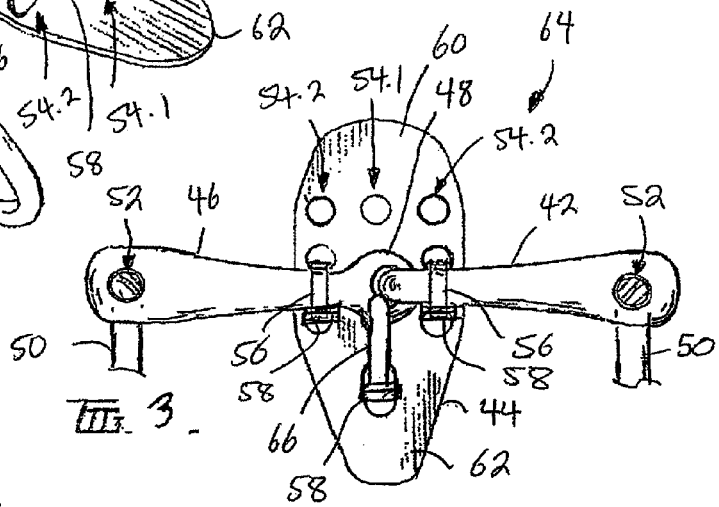
FIG. 3 shows a plan view of another embodiment, in accordance with the invention, of a bit with a jointed mouthpiece.

In FIG. 3, reference numeral 64 generally indicates a further embodiment, in accordance with the invention, of a bit. With reference to FIG. 2, like reference numerals refer to like parts, unless otherwise specified.

The bit 64 includes an extra cable tie 66 that passes through the eyelet 48 of one of the joints 46. This further secures the joints 46 to the plate 44. The ties 56, 56 help to maintain the integrity of the mouthpiece 42 if one of the eyelets 48 breaks.

The extra cable tie 66 can also be used to adjust the angle of the plate 44 relative to the mouthpiece 42, keeping it in the desired position to suit the individual horse. It will be appreciated that one or more further ties can be used to enhance the integrity of the mouthpiece and for further safety if one or both of the eyelets break.

Figure 10:
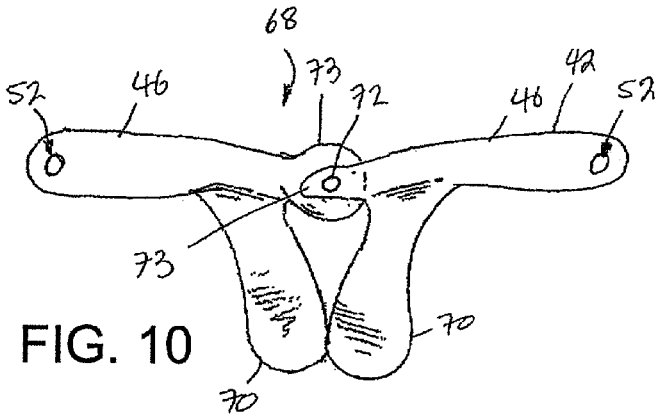
FIG. 10 shows another embodiment, in accordance with the invention, of a bit with a jointed mouthpiece in an open condition.
Figure 11:
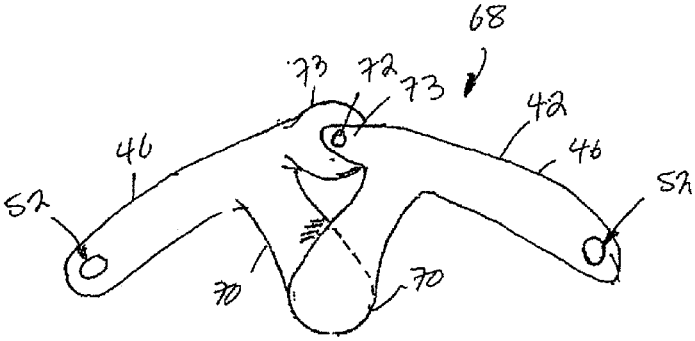
FIG. 11 shows a plan view of the bit of FIG. 10 in a partially closed or collapsed condition, in use.

In FIGS. 10 and 11, reference numeral 68 generally indicates another embodiment, in accordance with the invention, of a jointed bit. With reference to FIGS. 2 to 9, like reference numerals refer to like parts, unless otherwise specified.

In this embodiment, the tongue engaging member is defined by a flat portion 70 that projects in an operatively rearward direction from each joint 46. The portions 70 are configured so that, when the joints 46 pivot inwardly towards each other or collapse partially, in use, the portions 70 overlap to present a single structure that bears against the tongue 20 as shown in FIG. 11. In particular, one of the portions 70 is mounted higher that the other portion 70 to facilitate the overlap.

Each of the joints 46 and its associated portion 70 are in form of a one-piece structure, for example, a moulding.

Instead of being interconnected with eyelets 48, the joints 46 are interconnected with a pivot pin 72 that passes through differently dimensioned connected ends 73 of the joints 46 so that pivotal movement of the joints 46 with respect to each other is consistent to ensure overlapping.

Figure 4:
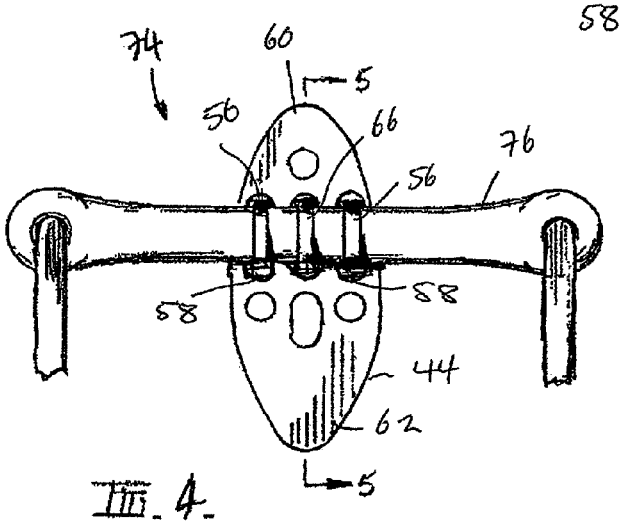
FIG. 4 shows another embodiment, in accordance with the invention, of a bit with a straight bar mouthpiece.
Figure 5:
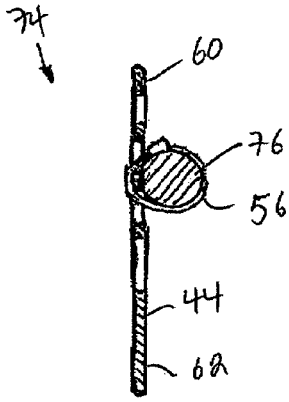
FIG. 5 shows a side sectioned view of the bit of FIG. 4.

In FIGS. 4 and 5, reference numeral 74 generally indicates another embodiment, in accordance with the invention, of a bit. With reference to FIGS. 2 and 3, like reference numerals refer to like parts, unless otherwise specified.

Instead of a jointed mouthpiece, the bit 74 has a one-piece mouthpiece 76, such as would be found with a straight bar, curb or Pelham bit. In this particular example, the mouthpiece 76 is a straight bar mouthpiece. The mouthpiece 76 can be of any suitable material. Examples of suitable material are rubber, stainless steel and brass.

Figure 6:
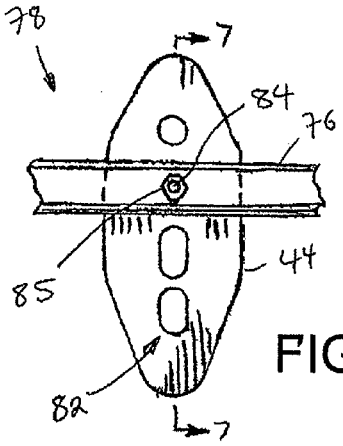
FIG. 6 shows a plan view of another embodiment, in accordance with the invention, of a bit with a straight bar mouthpiece.
Figure 7:
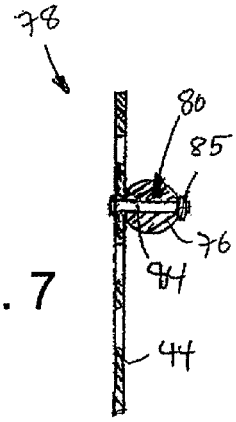
FIG. 7 shows a side sectioned view of the bit of FIG. 6.

In FIGS. 6 and 7, reference numeral 78 generally indicates another embodiment, in accordance with the invention, of a bit. With reference to FIGS. 2 to 5, like reference numerals refer to like parts, unless otherwise specified.

In this embodiment, the mouthpiece 76 defines an opening 80. The plate 44 defines one centrally oriented row of apertures 82 extending between the frontal and rearward portions 60, 62 of the plate 44. A fastener in the form of a bolt 84 and a nut 85 attaches the plate 44 to the mouthpiece 76. It will be appreciated that the position of the plate 44 relative to the mouthpiece 76 is adjustable by selecting a particular aperture 82 to receive the bolt 84.

Figure 8:
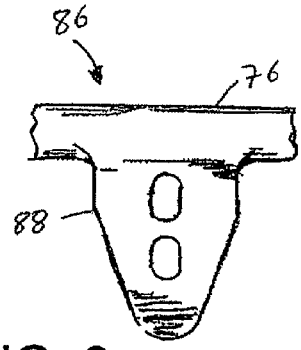
FIG. 8 shows a plan view of another embodiment, in accordance with the invention, of a bit with a unitary mouthpiece and tongue-engaging member.

In FIG. 8, reference numeral 86 generally indicates another embodiment, in accordance with the invention, of a bit. With reference to FIGS. 2 to 7, like reference numerals refer to like parts, unless otherwise specified.

A tongue engaging member in the form of a plate portion 88 extends backwardly from the mouthpiece 76. The mouthpiece 76 and the plate portion 88 are in the form of a one-piece structure, for example a moulding. The moulding can be of any suitable material including a plastics material, rubber, brass or stainless steel.

Figure 9:
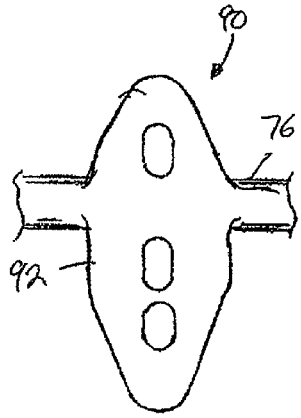
FIG. 9 shows a plan view of another embodiment, in accordance with the invention, of a bit with a unitary mouthpiece and tongue-engaging member.

In FIG. 9, reference numeral 90 generally indicates another embodiment, in accordance with the invention, of a bit. With reference to FIGS. 2 to 8, like reference numerals refer to like parts, unless otherwise specified.

A tongue engaging member in the form of a plate portion 92 extends forwardly and backwardly from the mouthpiece 76. The plate portion 92 and the mouthpiece 76 are in the form of a one-piece structure, for example a moulding.

FIG. 12 shows a bit 100 which comprises a two-part mouthpiece 102 and a tongue member 104 having a generally Z-shaped profile. The tongue member 104 is arranged on the mouthpiece 102 such that, when the mouthpiece 102 is received in an oral cavity of the horse, the tongue member 104 bears against a tongue of the horse, inhibiting movement of the tongue over the mouthpiece 102. The position of the tongue member 104 is adjustable with respect to the mouthpiece 102.

The mouthpiece 102 includes a pair of elongate mouthpiece members 106*a*, 106*b* complementarily engaged together about apertures 108 defined by the tongue member 104. The bit 100 further comprises a fastener 110 for extending through the mouthpiece members 106*a,b* and apertures 108 to fasten the mouthpiece members 106*a,b* to the tongue member 104. The apertures 108 are arranged in two rows, and the mouthpiece members 106*a,b* define passages 112 which can be aligned with respective rows to receive the fastener 110.

Figure 12A:
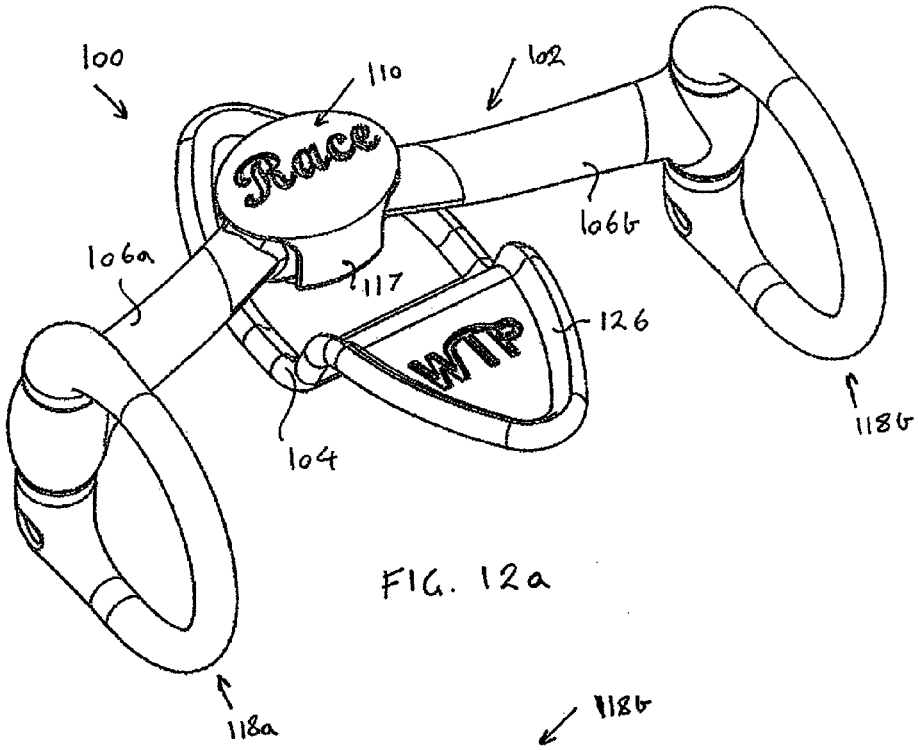
FIG. 12*a* shows an upper perspective view of a bit in accordance with another embodiment of the present invention.
Figure 12B:
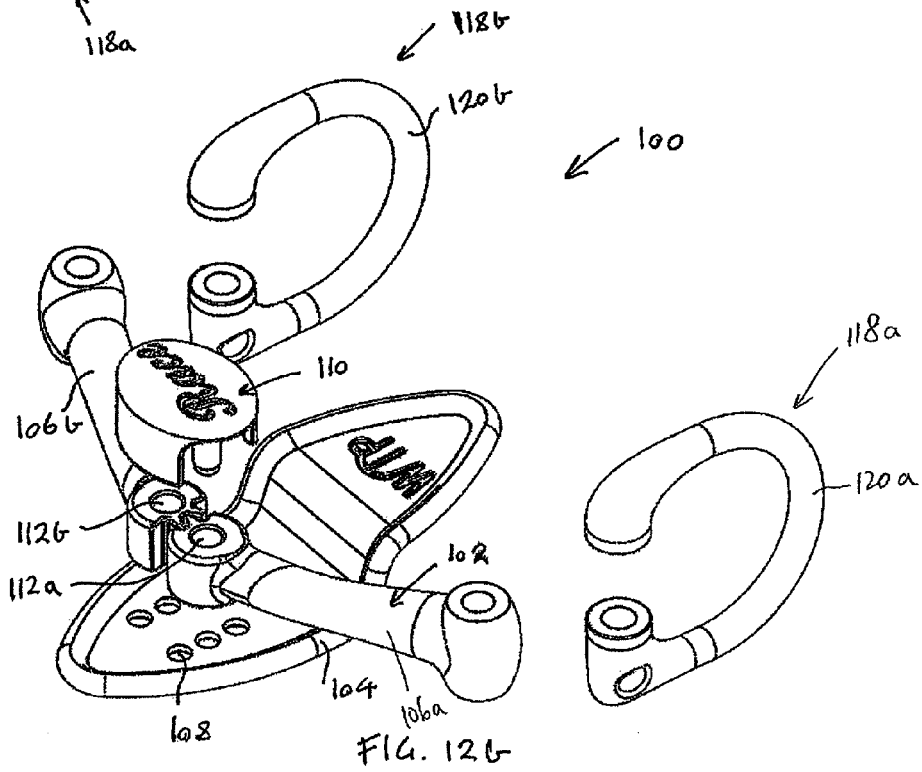
FIG. 12*b* shows an exploded upper perspective view of the bit of FIG. 12*a*.
Figure 12C:
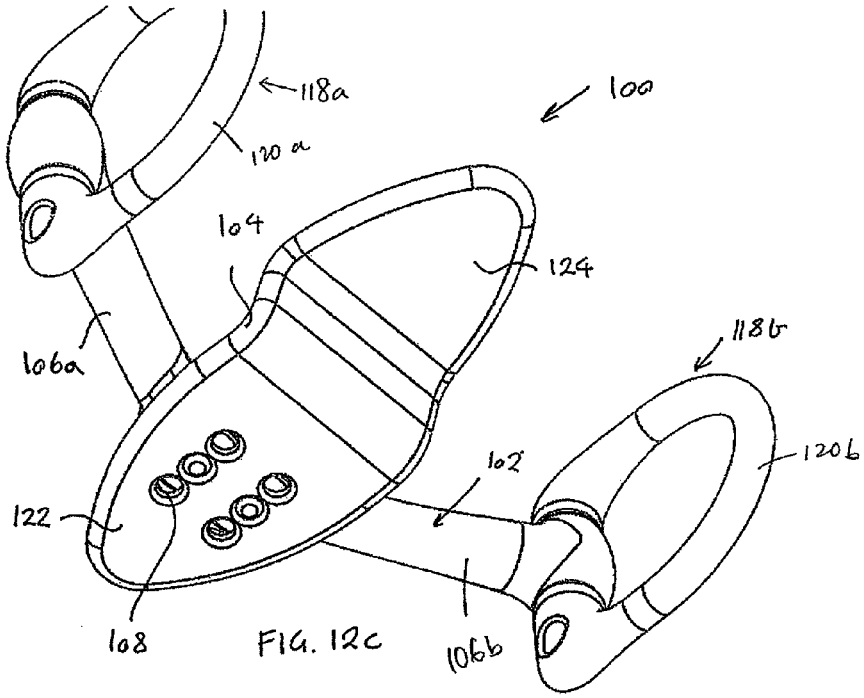
FIG. 12*c* shows a lower perspective view of the bit of FIG. 12*a*.
Figure 12D:
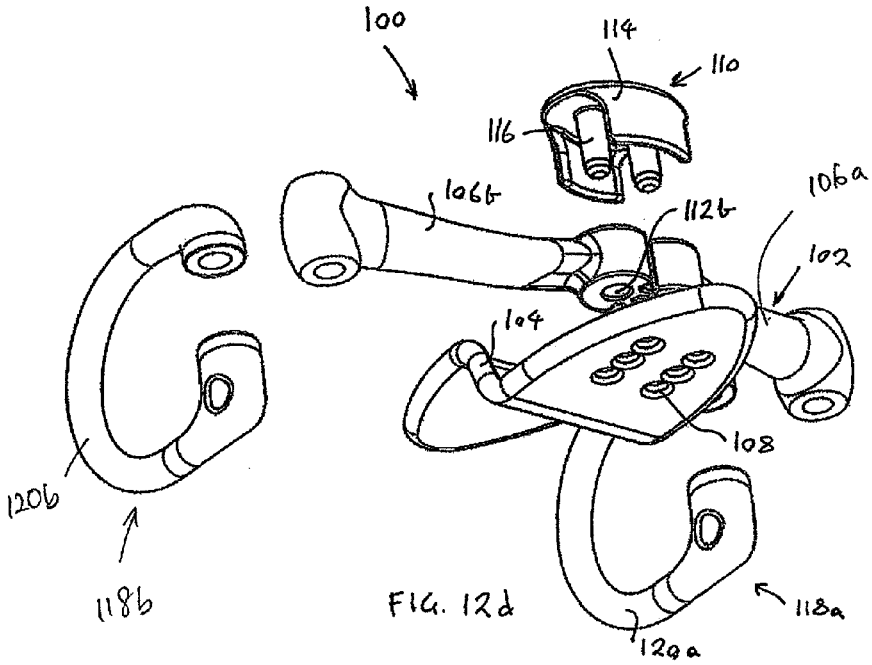
FIG. 12*d* shows an exploded lower perspective view of the bit of FIG. 12*c*.
Figure 13A:
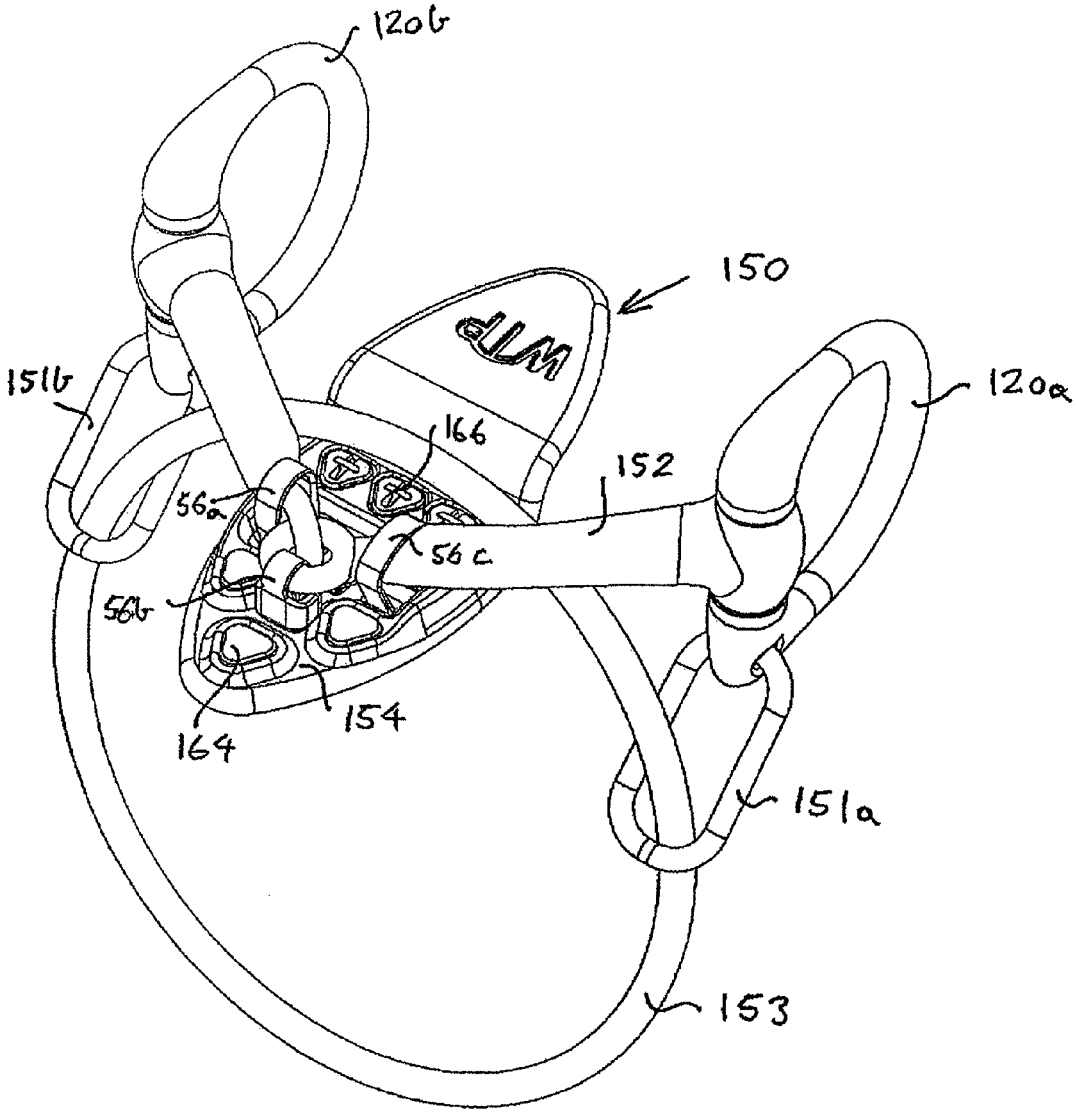
FIG. 13*a* shows an upper perspective view of a bit in accordance with another embodiment of the present invention.
Figure 13B:
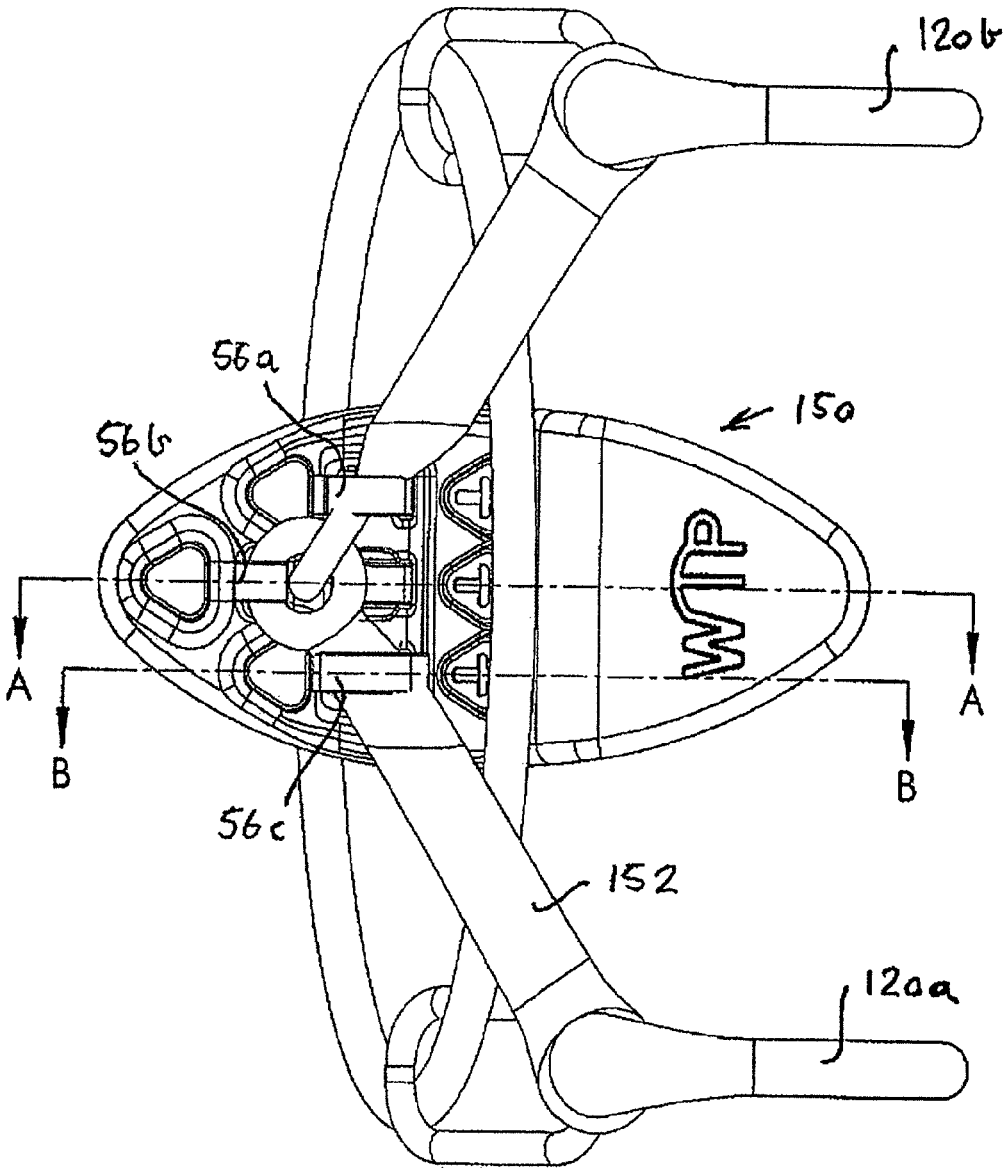
FIG. 13*b* shows a plan view of the bit of FIG. 13*a*.
Figure 13C:
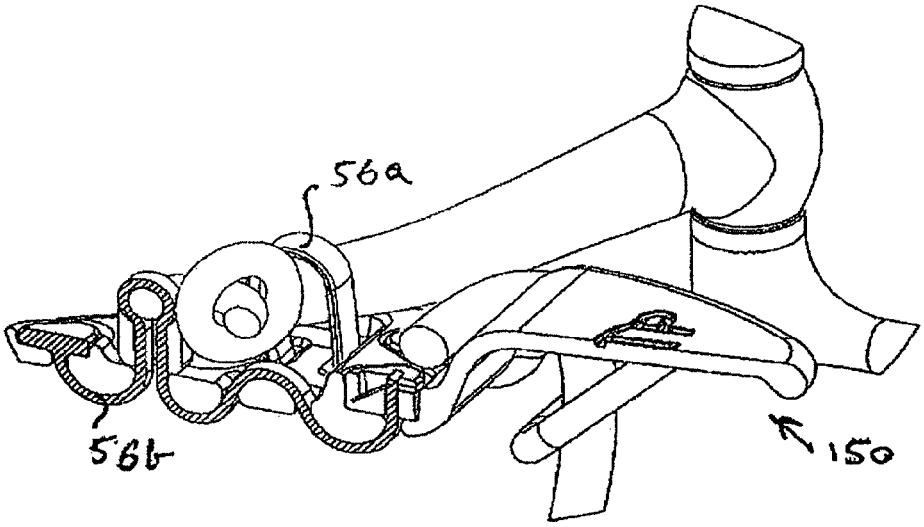
FIG. 13*c* shows a side sectional view of the bit through the line A-A of FIG. 13*b*.
Figure 13D:
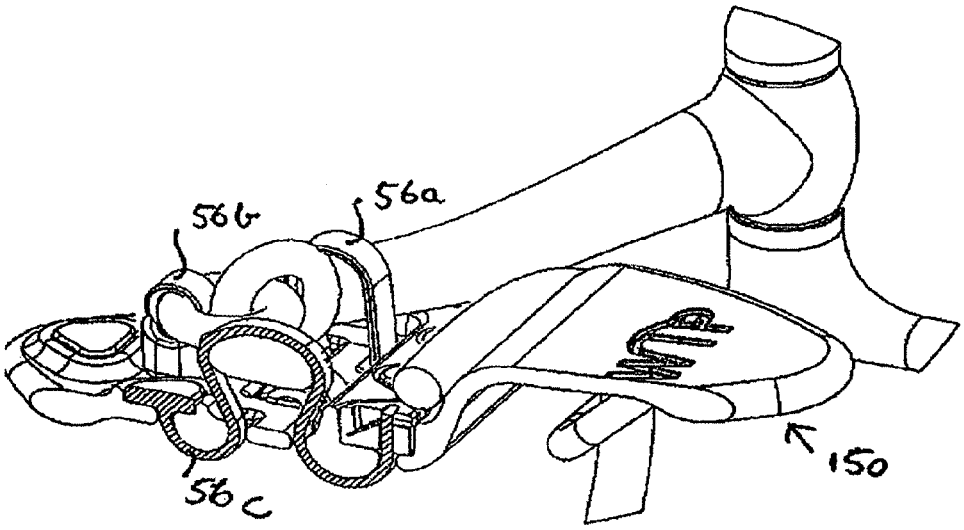
FIG. 13*d* shows a side sectional view of the bit through the line B-B of FIG. 13*b*.
Figure 14A:
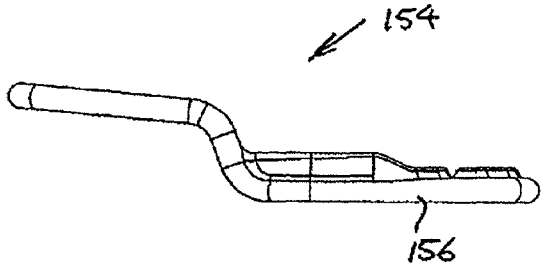
FIG. 14*a* shows a side view of a tongue member of the bit of FIG. 13*a*.
Figure 14B:
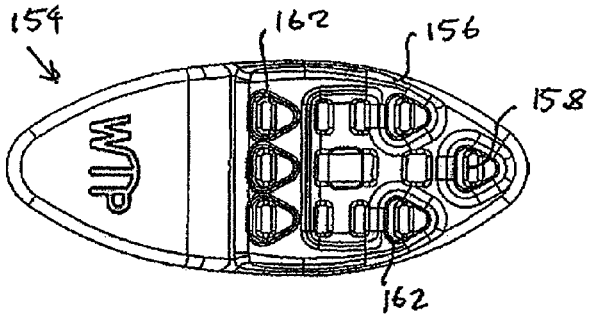
FIG. 14*b* shows a plan view of the tongue member of FIG. 14*a*.
Figure 14C:
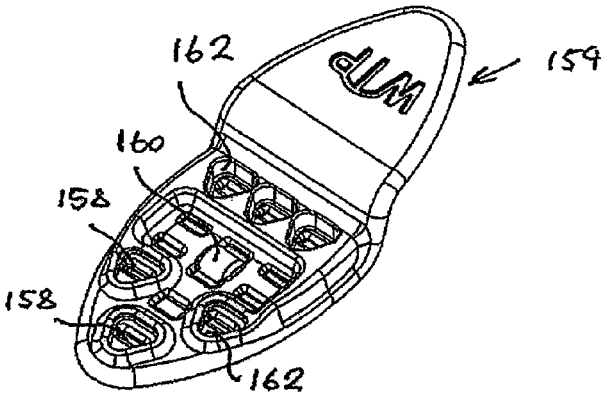
FIG. 14*c* shows an upper perspective view of the tongue member of FIG. 14*a*.
Figure 14D:
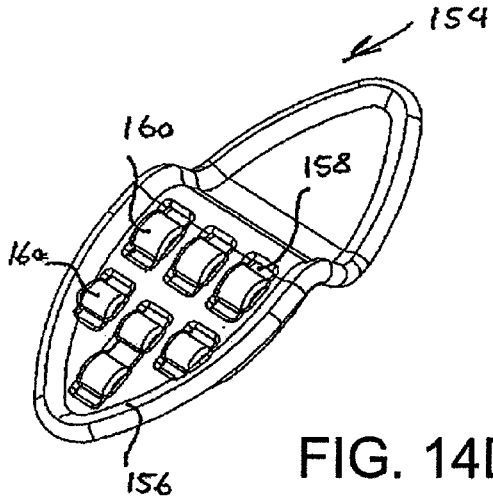
FIG. 14*d* shows a lower perspective view of the tongue member of FIG. 14*a*.

As can best be seen in FIG. 12*d*, the fastener 110 includes a cover 114 from which a pair of posts 116 can extend through the passages 112*a, b*. The posts 116 are internally threaded so that respective screws can be threaded through the apertures 108 and into posts 116 when fastening the mouthpiece 102 and tongue member 104 together. The engaged ends of the mouthpiece members 106*a,b* define interlocking engagement teeth and the mouthpiece members 106*a,b* can pivot about the posts 116. The interlocking engagement teeth keep the tongue member 104 in a central position over the horse's tongue which, in turn, prevents the horse shifting the tongue member 104 sideways with the tongue so that the tongue can then be slipped over the mouthpiece 102.

The bit 100 includes rings 118*a,b* at either end of the mouthpiece 102 to which a bridle and reins can be attached. Each ring 118*a,b* includes a ring portion 120*a,b* which can either be welded or screwed to a free end of a respective mouthpiece member 106*a,b*. As can best be seen in FIG. 12*a*, the cover 114 defines a rear wall 117 against which the mouthpiece members 106*a,b* abut when reigns attached to the rings 118*a,b* are pulled rearward in use. In this manner, the pivotal range of motion of the mouthpiece members 106*a*, 106*b* is restricted so that the rings 118*a,b* do not push against the side of the horse's head which could otherwise cause the side of the horse's mouth to be cut by the horses sharp teeth.

As can best be seen in FIG. 12*c*, the Z-shaped tongue member 104 includes a lower frontal portion 122 in which the apertures 108 are formed, and a higher rear portion 124. The tongue member 104 is shaped to accommodate the horse's tongue which is thicker and higher towards the rear of the head. If the horse rears, the rear portion 124 pushes downward on the tongue deterring the horse from pulling and impeding the tongue from passing over the mouthpiece 102. Each portion 122, 124 oppositely tapers to a respective apex which is rounded to minimise the possibility of cutting the horse's tongue. The tongue member 104 also includes an endless raised lip 126 (see. FIG. 12*a*) about its periphery which also minimises the possibility of cutting the horse's tongue. The apertures 108 are arranged in two rows to readily facilitate the adjustment of the mouthpiece 102 with respect to the tongue member 104 which, in turn, remains centrally located within the horse's mouth.

FIG. 13 shows a bit 150 comprising a two-part mouthpiece 152 (of similar construction to mouthpiece 42 of FIG. 2) and a tongue member 154 (of similar construction to tongue member 104 of FIG. 12) once again having a generally Z-shaped profile. Each ring portion 120*a,b* defines an aperture for receiving a pivoting linkage 151*a,b*, in turn, linking a racing ring bit 153 fitted around the horse's jaw.

Turning to FIG. 14, the lower portion 156 of the tongue member 154 includes slots 158 arranged in pairs. The underside of the lower portion 156 defines curved surfaces 160 between respective slot pairs. In use, cable ties 56*a, b, c* pass around the curved surfaces 160 which impede them from otherwise kinking or breaking. The lower portion 156 of the tongue member 154 further includes triangular sockets 162 in register with slots 158 for receiving complementarily shaped terminations (i.e. heads 164 and tails 166) of the cable ties 56*a, b, c*. As can best be seen in FIG. 13, the slots 158 are arranged in three rows to accommodate three respective cable ties 56*a*, 56*b*, 56*c*. Tightening the central cable tie 56*b* causes the rear portion 124 of the tongue member 104 to create greater pressure on the horse's tongue whereas slackening the central cable tie 56*b* causes the rear portion 124 to create lesser pressure on the hose's tongue.

Throughout the specification, including the claims, where the context permits, the term "comprising" and variants thereof such as "comprises" or "comprising" are to be interpreted as including the state of integer or integers without necessarily excluding any other integers.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art. For example, instead of the cable ties, the fastening arrangement could be in the form of sleeve or the like fast with the tongue engaging member and arranged about the mouthpiece to ensure the alleviation of possible discomfort to the horse.

Applicant submits that this invention provides a safe and comfortable means for preventing a horse from placing its tongue over the mouthpiece of a bit. In the case of jointed mouthpieces, the invention prevents the mouthpiece from pinching the tongue. The tongue engaging member also helps to prevent the bit from pulling through the horse's mouth.

Applicant has identified a major problem in the industry associated with horses placing their tongues over the mouthpiece of the bit. The resultant choking and discomfort can cause a horse to perform badly. In the horse-racing, show jumping and other equestrian industries such poor performance can be both inhumane and costly. Thus, the invention provides a means for improving the humanness and profitability of these industries.

With conventional bits, Applicant has found that horses can get into a habit of placing their tongues over the bit. This is analogous to a human biting nails. Neither the horse nor the human is particularly fond of the habit, but in both cases the habit is compulsive. Much like a non-removable glove or unpleasant tasting ointment for humans, the invention provides a gentle and humane means for weaning the horse off the habit.

Where the fasteners such as cable ties are used, the tongue engaging member can easily be transferred from one bridle to another if required. Furthermore, the fact that the tongue engaging member in a number of the embodiments is adjustable relative to the mouthpiece, allows adjustment to suit various jaw length differences. This suits, for example, jaw length difference of up to 20 centimeters between a 2-year old horse and an 8-year old horse.

A particular benefit of the invention is apparent when applied to the embodiment incorporating a jointed mouthpiece. It is known that such mouthpieces can break at the eyelets due to moulding imperfections during fabrication. Such a breakage can have tragic consequences for example at full gallop or during a showjumping event. With a fastener received through one or both of the eyelets, the integrity of the mouthpiece can be maintained if an eyelet breaks. It follows that the Applicant submits that the invention provides an important safety enhancement to equestrian activities.

The invention claimed is:

1. A bit which comprises a mouthpiece having two mouthpiece members; and a tongue member arranged on the mouthpiece such that, when the mouthpiece is received in an oral cavity of an animal, the tongue member bears against a tongue of the animal, each mouthpiece members defining a corresponding set of interlocking engagement teeth, the interlocking engagement teeth of one of the sets being configured to push against the interlocking engagement teeth of the other set such that the movement of one mouthpiece member in a first direction causes the other mouthpiece member to move in a second direction opposite to the first direction to thereby maintain the tongue member in a central position over the animal's tongue during movement of the mouthpiece members.

2. A bit as claimed in claim 1, in which a position of the tongue member is adjustable with respect to the mouthpiece.

3. A bit as claimed in claim 2, wherein the mouthpiece includes a pair of elongate mouthpiece members complementarily engaged together and the tongue member defining apertures, the bit further comprising:

a fastener for extending through the mouthpiece members and the apertures to fasten the mouthpiece members to the tongue member.

4. A bit as claimed in claim 3, wherein the apertures are arranged in two rows, and the mouthpiece members define passages which can be aligned with respective rows to receive the fastener.

5. A bit as claimed in claim 4, wherein the fastener includes a cover from which a pair of posts can extend through the passages, the cover restricting a pivotal range of motion of the mouthpiece members, the cover being configured to hold the two sets of interlocking engagement teeth together in engagement in the event of a post failure.

6. A bit as claimed in claim 3, further including rings at either end of the mouthpiece to which a bridle and reins can be attached.

7. A bit as claimed in claim 2, wherein a surface area of the tongue member has a lower frontal portion connected to a higher rear portion, with each portion oppositely tapering to a rounded apex.

8. A bit as claimed in claim 2, wherein the tongue member has a generally Z-shaped profile.

9. A bit as claimed in claim 1, in which the tongue member is fastened to the mouthpiece with a fastening arrangement.

10. A bit as claimed in claim 9, in which the tongue member is in the form of a plate with a number of perforations to accommodate the fastening arrangement, the perforations being configured so that selection of perforations can provide adjustability of the plate with respect to the mouthpiece.

11. A bit as claimed in claim 1, in which the tongue member is pivotal with respect to the mouthpiece, the mouthpiece being operatively arranged intermediate front and rear edges of the tongue member such that, when a frontal portion of the tongue member is urged towards a roof of the oral cavity, a rearward portion presses onto the tongue to inhibit excessive pulling by the animal.

12. A bit as claimed in claim 1, wherein the two mouthpiece members are each in direct contact with the tongue member, while the interlocking engagement teeth maintain the tongue member in the central position over the animal's tongue.

13. A bit as claimed in claim 1, wherein the tongue member includes a raised lip about its periphery.

14. A bit as claimed in claim 1, wherein a surface area of the tongue member is bent.

15. A bit as claimed in claim 14, wherein the tongue member is curved.

16. A tongue member for a bit, the tongue member capable of being fastened to a mouthpiece of the bit and being configured so that, when the mouthpiece is received in an oral cavity of an animal, the tongue member bears against a tongue of the animal, inhibiting movement of the tongue over the mouthpiece, the mouthpiece having two mouthpiece members, each mouthpiece member defining a corresponding set of interlocking engagement teeth, the interlocking engagement teeth of one of the sets being configured to push against the interlocking engagement teeth of the other set such that the movement of one mouthpiece member in a first direction causes the other mouthpiece member to move in a second direction opposite to the first direction to thereby maintain the tongue member in a central position over the animal's tongue during movement of the mouthpiece members.

* * * * *